United States Patent [19]

Right et al.

[11] Patent Number: 4,954,809

[45] Date of Patent: Sep. 4, 1990

[54] CONTINUITY-ISOLATION TESTING FOR CLASS A WIRING IN FIRE ALARM SYSTEM

[75] Inventors: Robert W. Right, Huntington, Conn.; Simon T. Carter, Brighton, England

[73] Assignee: General Signal Corporation, Stamford, Conn.

[21] Appl. No.: 345,596

[22] Filed: May 1, 1989

[51] Int. Cl.[5] ..... G08B 29/00

[52] U.S. Cl. ..... 340/516; 340/518; 340/505; 340/508

[58] Field of Search ..... 340/516, 518, 514, 505, 340/508, 506, 825.01–825.1; 324/500

[56] References Cited

U.S. PATENT DOCUMENTS

| | | | |
|---|---|---|---|
| 4,253,091 | 2/1981 | Frydman | 340/508 |
| 4,567,471 | 1/1986 | Acar | 340/505 |
| 4,742,334 | 5/1988 | Teich et al. | 340/505 |
| 4,777,473 | 10/1988 | Weston et al. | 340/505 |
| 4,803,465 | 2/1989 | Prysby | 340/508 |
| 4,816,808 | 3/1989 | Morita | 340/505 |

*Primary Examiner*—Donnie L. Crosland

*Attorney, Agent, or Firm*—Robert R. Hubbard; John F. Ohlandt

[57] ABSTRACT

A fire alarm system in which a large number of terminal units, comprising detectors and interface circuits, at a variety of locations are coupled or connected in separate, independent loops of the system, each of the scattered terminal units being addressable from a central control panel. The arrangement is such that serial synchronous power transmission and data communication is effectuated over the individual loops of the system. The improvement resides in providing continuity-isolation testing for a Class A wiring scheme involved in the loops. By Class A operation is meant that there are two separate channels involved in each loop. A continuity test is sequentially performed on both channels of the loop such that discontinuities can be precisely located.

4 Claims, 2 Drawing Sheets

CONTINUITY-ISOLATION TESTING FOR CLASS A WIRING IN FIRE ALARM SYSTEM

BACKGROUND OF THE INVENTION

This invention relates to a fire alarm or similar system, and more particularly to a microprocessor-based system in which serial synchronous power transmission and data communication are provided between a central station or panel and groups of terminal units; such system functioning, by means of independently operable loop controllers, to signal or indicate alarm conditions and the like so that supervisory personnel can be adequately warned of hazardous conditions.

In a fire alarm system of the type just described, groups of terminal units are addressed by a so-called polling routine so that a microprocessor in the respective independent loop controllers can determine the alarm states, if any, of its terminal units on a continuous basis. Thus, each of the many units, for example 100 units on a given loop or line, can be addressed cyclically, e.g., once every several seconds or so. If a given unit during any cycle is determined to be in the alarm state, then that information is communicated to the associated loop controller, and therefrom to a master controller so that a warning to supervisory personnel can be given.

When one or more units are found to be in alarm, the information is displayed on the central panel. Such information is also printed out by a printing device. Meanwhile, information is obtained by the loop controller, for example, as to the type of terminal unit that is in the alarm state, and its location. Moreover, the loop controller, upon receiving notification of an alarm status sends a command to the particular terminal unit in alarm to illuminate its light emitting device so that personnel stationed nearby may precisely locate the outbreak of fire.

A fuller understanding of the operation of such a fire alarm system will be gained as the description of a detailed embodiment of the present invention proceeds. At that time, reference will be made to FIG. 1, in which the context of the invention is depicted, such context being a known fire alarm system of the type just described.

Accordingly, it is a fundamental object of the present invention to provide specialized testing or checking of the loops involved in the described fire detection system or the like, so as to be able to pinpoint the location of discontinuities or breaks in the wiring of such loops.

Another object is to report back to a central controller, as the testing procedure is being carried out, so that an indication can be provided at the central control panel that, in one testing mode, certain ones of the terminal units (detectors) appear to be isolated, i.e., they do not report back when addressed; and, in another testing mode, certain others appear to be isolated.

SUMMARY OF THE INVENTION

The above and other objects are fulfilled by a primary feature of the present invention which provides for continuity-isolation testing through a polling routine executed by an individual loop controller over two channels of the loop to determines what terminal units are not reporting back to the loop controller (and thence to a main or central controller). Preferably, the testing is accomplished by suitable programming that involves sequentially transmitting a particular code over the two channels in a Class A wiring scheme or arrangement. By Class A wiring—as distinguished from Class B—is meant a scheme or arrangement where two lines or wires are extended from a pair of terminals at the loop controller and are formed in a loop which is returned to another pair of terminals on that same loop controller. The first channel is the channel defined as exiting from the first pair of terminals, and the second channel is the channel defined as exiting the second pair of terminals. In this manner, one is able to isolate nonreporting devices when the test code is transmitted first from the first channel, as defined, and thus from the second channel, as also defined.

As previously stated, then, a primary feature may be defined as apparatus for continuity-isolation testing in a fire alarm system or the like, comprising: a transmission loop including two lines extending from respective separated pairs of terminals; a loop controller including both pairs of terminals such that said loop defines first and second channels with which said controller can communicate; a plurality of terminal units connected to said transmission loop; each of said terminal units having comparison means for determining whether a received address signal coincides with an identification address stored in the terminal unit, said comparison means producing an output signal responsive to coincidence; said loop controller being connected to the transmission loop and including means for transmitting a plurality of address signals cyclically to said terminal units; said loop controller further including means for sending out test signals, in the form of an address code, on the respective separated pairs of terminals defining said first and second channels, such that it can be determined that particular devices not reporting back are isolated from said first channel, and that particular devices not reporting back are isolated from said second channel, whereby all the nonreporting devices can be ascertained such that numbers of discontinuities can be resolved.

DESCRIPTION OF PREFERRED EMBODIMENT

Figure 1:
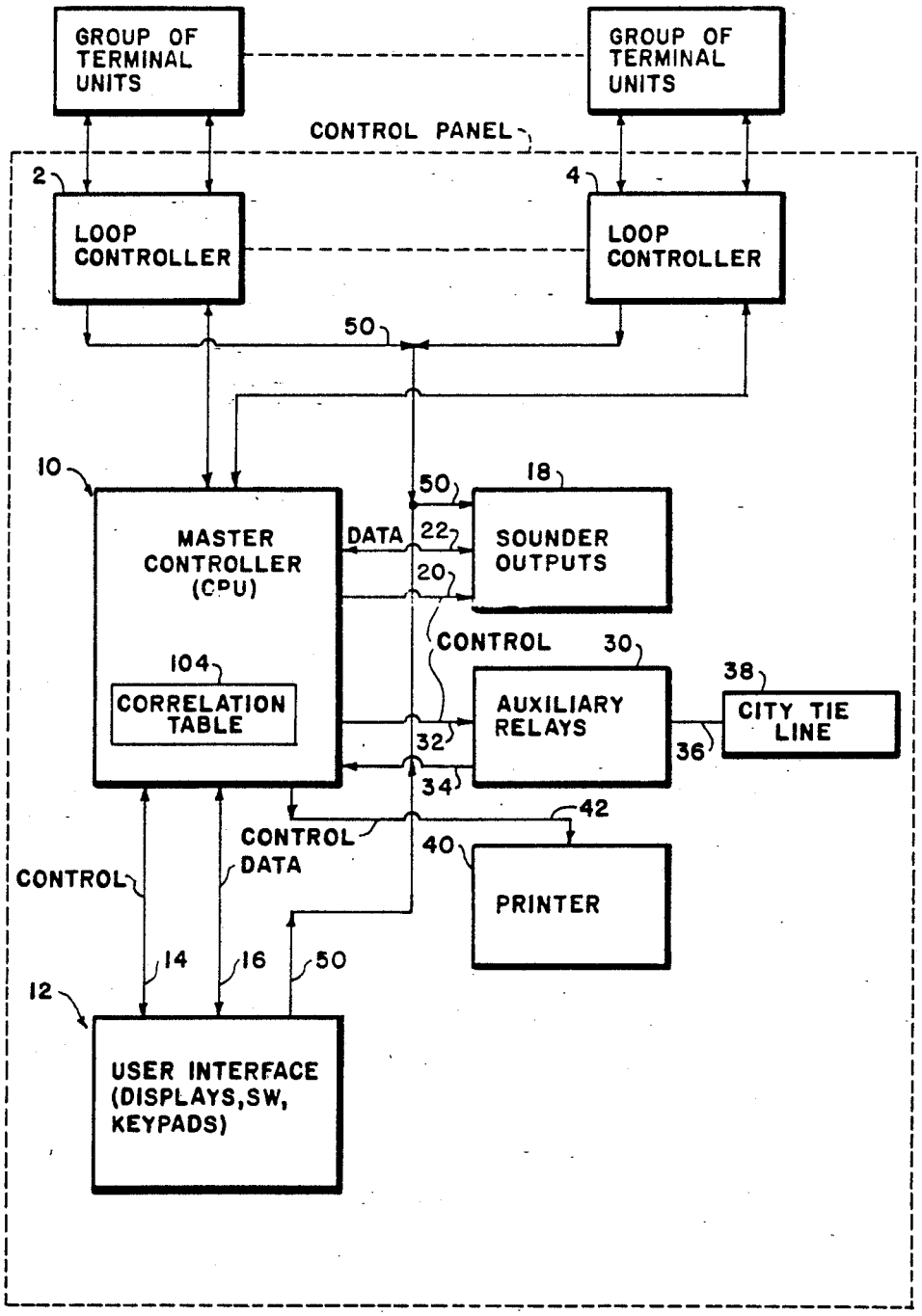
FIG. 1 is a block diagram of the fire alarm system forming the context in which the present invention is operative.

Referring now to the figures of the drawing and, in particular, first to FIG. 1, there will be seen a functional block diagram of the entire system for detecting the outbreak of fire or other hazardous conditions. For the sake of simplicity, certain equipment such as batteries, power mains, chargers and the like, normally used for supplying power to the system, have not been shown in FIG. 1.

It will be understood that the overall system depicted in FIG. 1 is one in which the related invention of application ED-245 may be incorporated. That related invention is adapted to operate as part of a given loop controller, such as loop controllers 2 and 4 seen in FIG. 1.

It is believed to be sufficient in connection with the invention of the present application to note that a master controller 10 is at the center of the system. Such controller is responsible for the "high level" functions involved. Thus, it issues commands and instructions to individual loop controllers and receives responses from these loop controllers. Moreover, the master controller 10 communicates with a user interface 12 to permit the user to enter a variety of commands or instructions to the system. Accordingly, the user interface includes a variety of display means, switches, keypads, and so forth, such user interface being well known to those skilled in the art. A control line 14 and a data bus or line 16 interconnect such user interface with the master controller 10.

For providing a variety of audible signals in order that supervisory personnel may be properly alerted, a group of sounder outputs is provided as designated by the block 18 (to the right of the master controller). The sounder outputs are interconnected with the master controller 10 by control line 20 and data line or bus 22. A set of auxiliary relays designated 30 is likewise connected to the master controller 10; again, by means of similar control and data lines, in this case by control line 32 and data line 34.

One of the auxiliary relays of the set 30 can be selectively connected by the connection 36 to a city tie line 38, whereby a municipal fire department or the like can be suitably notified. This selectivity feature is disclosed and claimed in related application ED-246, assigned to the assignee of the present application.

It will also be noted that a printer for printing out significant information, thereby making a permanent record of reported conditions, is designated 40 and is connected by control line or connection 42 to the master controller 10.

In order to Provide an evacuate override signal as an indicator for disastrous conditions (fail-safe), a line 50 is extended between the user interface 12 and the sounder outputs 18, such line also extending to the loop controllers 2 and 4. It will be understood that seven loops are normally involved in the system of the type described; thus the dotted lines represent five other loop controllers and their loops. Also, it will be appreciated that the seven loops function independently of each other and communicate with the master controller only when called by the master controller; or in the event of an emergency condition, for example, if terminal units go into alarm.

If anything of disastrous consequences goes wrong with any of the looP controllers or the user interface, signals are fed into the sounder outputs 18 to provide an indication of such disastrous conditions.

A group of exemPlary terminal units 70–78, it will be understood, is connected across a pair of lines 80 and 82, which are formed to constitute a class A wiring scheme as already explained. In other words, the pair of lines are formed in a complete loop by first connecting one end of each line to a pair of terminals 84 on the loop controller 2; further, by connecting the opposite end of each line to another, physically separated pair of terminals 86 on the same loop controller, as seen particularly in FIG. 2.

Figure 2:
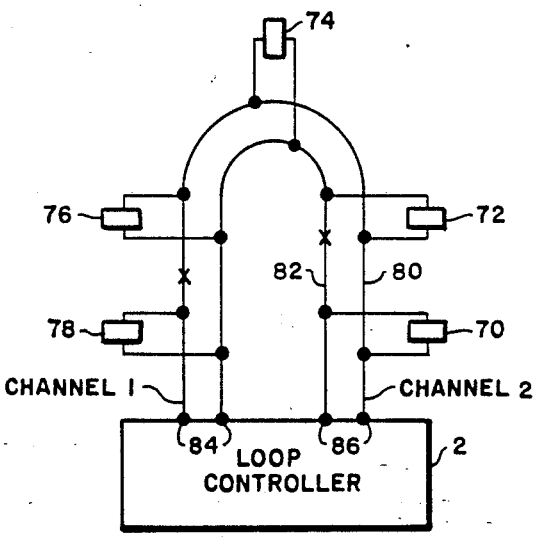
FIG. 2 is a simplified functional block diagram with reference to the class A wiring for the fire alarm system; that is, wiring according to which two channels are involved.
Figure 3:
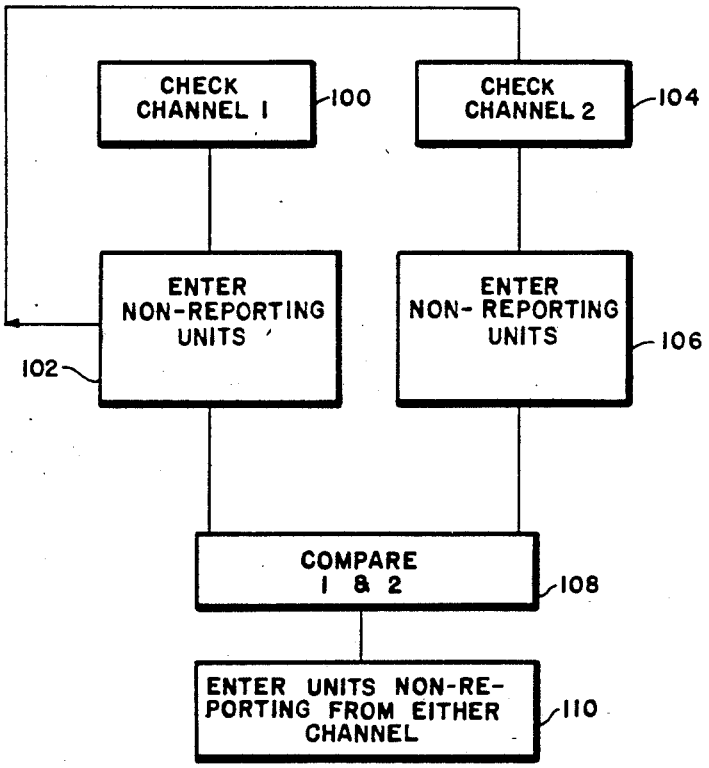
FIG. 3 is a flow chart depicting the operations involved in the continuity-isolation testing technique of the Present invention.

Now, by referring to FIG. 2, and also to FIG. 3, which is a flow chart diagram in accordance with the principles of the present invention, it will become apparent how the continuityisolation testing is performed.

The loop controller, for example, controller 2 in FIG. 2 first performs the operation 100 of sending out test signals, in the form of an address code, on the pair of terminals 84 defining the first channel or channel 1. In the event that there is a fault such as a discontinuity X on the line 80 between units 76 and 78, only unit 78 will respond to its address code and report its state. In accordance with operation 102, data is stored in loop controller 2 indicating that all the other units, on the loop, that is, units 76, 74, 72, and 70 have not reported.

Thereafter, a test signal, again in the form of an address code, is sent out from loop controller 2 on channel 2, i.e., by way of the terminals 86. This is shown in FIG. 3 as operation 104.

Another fault exists in the form of another discontinuity at the X mark in line 8Z between units 70 and 72, which means that only unit 70 will respond. One now knows that only unit 70 has responded on channel 2, whereas units 72, 74, 76, and 78 are isolated and have not reported. Following the operation of entering the non-reporting units in memory, operation 108 is effectuated, according to which both of the separate testing responses are taken into account and compared.

By operation 110, a report is made back to the master controller and entry is made to the effect that there are two discontinuities in the loop from loop controller 50, since units 72, 74, and 76 are non-reporting from either channel test.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

We claim:

1. Apparatus for continuity-isolation testing in a fire alarm system or the like, comprising:

a transmission loop defined by two lines extending from respective, separated pairs of terminals;

a loop controller including both pairs of terminals such that said loop defines first and second channels by which said controller can communicate with said loop;

a plurality of terminal units connected to said transmission loop; each of said terminal units having comparison means for determining whether a received address signal coincides with an identification address stored in the terminal unit, said comparison means producing an output signal responsive to coincidence;

said loop controller being connected to the transmission loop and including means for transmitting a plurality of address signals cyclically to said terminal units;

said loop controller further including means for systematically sending out isolation test signals, in the form of an address code, on the respective, separated pairs of terminals defining said first and second channels, for alternate bi-directional transmission on said transmission loop;

means in said loop controller for entering data to the effect that particular devices on said transmission loop but reporting back are isolated from said first channel, and that particular devices on said same transmission loop not reporting back are isolated from said second channel; and means for comparing said data from said first and second channels, whereby all the non-reporting devices can be ascertained and a plurality of discontinuities on the same transmission loop can be resolved.

2. Apparatus as defined in claim 1, said loop controller further comprising means for generating an alarm-state display command signal when response data from a terminal unit indicates that an alarm state exists, and for transmitting said command signal to produce a visual indication at the respective light emitting device of said given terminal units that are in an alarm state.

3. Apparatus as defined in claim 2, further comprising a master controller for instructing said loop controller to perform said isolation testing to determine discontinuities in said transmission loop and for reporting terminal units which are non-reporting for either channel test.

4. Apparatus as defined in claim 3, further comprising a display and a printer, and in which said master controller transmits the information as to the units non-reporting on either channel of said transmission loop to the user on said display and said printer.

* * * * *